US011447375B2

(12) United States Patent
Huang

(10) Patent No.: US 11,447,375 B2
(45) Date of Patent: Sep. 20, 2022

(54) EASILY CHANGEABLE ASSEMBLY TYPE POWER WINCH

(71) Applicant: Comeup Industries Inc., New Taipei (TW)

(72) Inventor: Shih Jyi Huang, New Taipei (TW)

(73) Assignee: Comeup Industries Inc., New Taipei (TW)

( * ) Notice: Subject to any disclaimer, the term of this patent is extended or adjusted under 35 U.S.C. 154(b) by 0 days.

(21) Appl. No.: 17/111,901

(22) Filed: Dec. 4, 2020

(65) Prior Publication Data

US 2022/0098013 A1 Mar. 31, 2022

(30) Foreign Application Priority Data

Sep. 30, 2020 (TW) ..... 109212941

(51) Int. Cl.
*B66D 1/14* (2006.01)
*B66D 1/28* (2006.01)

(52) U.S. Cl.
CPC *B66D 1/14* (2013.01); *B66D 1/28* (2013.01)

(58) Field of Classification Search
CPC ... B66D 1/12; B66D 1/14; B66D 1/28; B66D 1/40
See application file for complete search history.

(56) References Cited

U.S. PATENT DOCUMENTS

| | | | | | |
|---|---|---|---|---|---|
| 3,698,690 | A * | 10/1972 | Beaver | B66D 1/14 | 254/340 |
| 4,552,340 | A * | 11/1985 | Sheppard | B66D 3/18 | 254/346 |
| 4,736,929 | A * | 4/1988 | McMorris | B66D 1/22 | 254/323 |
| 6,494,437 | B1 * | 12/2002 | Boyer | B66D 5/08 | 254/323 |
| 6,672,568 | B1 * | 1/2004 | Rawlinson | A01B 59/066 | 254/323 |
| 7,556,240 | B1 * | 7/2009 | Bauer | B66D 1/14 | 254/294 |
| 7,913,978 | B1 * | 3/2011 | Trihey | B66D 3/006 | 254/323 |
| D741,039 | S * | 10/2015 | Huang | D34/33 | |
| 10,112,808 | B2 * | 10/2018 | Fretz | B66D 1/36 | |
| 10,625,995 | B2 * | 4/2020 | Vaughn | B66D 1/16 | |
| 11,001,483 | B2 * | 5/2021 | Zheng | B66D 1/485 | |
| 2008/0001132 | A1 * | 1/2008 | Huang | B66D 1/12 | 254/362 |
| 2012/0290226 | A1 * | 11/2012 | Williams | G01L 5/108 | 702/41 |

(Continued)

*Primary Examiner* — Michael E Gallion
(74) *Attorney, Agent, or Firm* — Alan D. Kamrath; Karin L. Williams; Mayer & Williams PC

(57) ABSTRACT

An easily changeable assembly type power winch includes a power source, a deceleration device, an outer casing, a rope wheel, a first support frame and a second support frame. After the power winch and two cross plates are assembled to form a basic assembly, a rope outlet board and an electric control box are assembled with the basic assembly to form the power winch in a horizontal assembly mode or an upright assembly mode, and these two assembly modes can be switched quickly to achieve the effects of reducing the manufacturing cost, improving the convenience of assembling, and broadening the scope of application.

2 Claims, 8 Drawing Sheets

(56) References Cited

U.S. PATENT DOCUMENTS

| | | | | |
|---|---|---|---|---|
| 2014/0084229 | A1* | 3/2014 | Morrison | B66D 3/20 254/344 |
| 2018/0118529 | A1* | 5/2018 | Vaughn | B66D 1/22 |
| 2018/0127246 | A1* | 5/2018 | Fretz | B66D 1/12 |
| 2019/0092609 | A1* | 3/2019 | Cui | B66D 1/00 |
| 2020/0131010 | A1* | 4/2020 | Kukula | B66D 1/16 |
| 2021/0316972 | A1* | 10/2021 | Huang | B66D 1/22 |
| 2021/0332884 | A1* | 10/2021 | Huang | F16H 63/3026 |

* cited by examiner

EASILY CHANGEABLE ASSEMBLY TYPE POWER WINCH

BACKGROUND OF THE INVENTION

Field of the Invention

The present invention relates to a power winch, and more particularly to the power winch that can be switched between a horizontal assembly mode and an upright assembly mode to broaden the scope of application.

Description of the Related Art

Power winch is a power tool used to lift a load up and down or drag the load to move near and away. For example, a "lifting hoist" used for lifting cargos or heavy objects for high-rise buildings is one of the common power winches, and a "rope hoist" installed in front of a jeep or onto an off-road vehicle for towing other vehicles or objects or rescuing other people is another kind of power winch. The operation principle of the power winch relies on a power source (such as power motor or an electric motor) that outputs a transmission power to control the winch to be operated in a forward or reverse direction. After a deceleration mechanism, a rope wheel is driven to perform a forward rotation or a reverse rotation in order to release or retract a rope (including but not limited to steel rope or synthetic rope), and the front end of the rope having a heavy-duty hook for hooking and hanging a load (such as a heavy object, another other, another object, etc.) in order to move the load.

In addition to the aforementioned basic structural assembly, a conventional power winch is also equipped with an electric control box, and the power source and a long-distance wireless (or long-distance wired) remote control to achieve an electric connection, so as to control the ON/OFF, the rotational direction and speed, and the outputted force of the power source, etc., and a display panel (or a display screen) is mounted onto the front or a slightly inclined surface of the electric control box and primarily used for displaying the operating status and related information of the power winch including a power-on display (showing that the power source is situated in an electrically connection status), a power level display (showing the power level of a power supply connected to a motor vehicle), a temperature warning display (showing the temperature of the power source), a rope direction display (showing the situation of releasing the rope or retracting the rope) and a wireless operation display (showing the connection of a wireless remote controller), etc. To facilitate operators to view the display panel, the electric control box is generally installed at the upper position of the top of the whole power winch.

The conventional power winch can be installed in two assembly modes: a horizontal assembly mode and an upright assembly mode, wherein the horizontal assembly mode refers to the assembly mode of a power winch having a side surface with a width greater than its height, and the rope remains to be retracted from the front, and the electric control box is maintained at the upper position of the top of the power winch. On the other hand, the upright assembly mode refers to the assembly mode of a power winch having a side surface with a height greater than its width, and the rope remains to be retracted from the front and the electric control box is maintained at the top of the top of the power winch. To cope with the difference between these two modes, the development of the conventional power winch requires two different sets of assemblies and assembling procedures, and thus incurring a higher manufacturing cost, and causing inconvenience of the assembling.

SUMMARY OF THE INVENTION

In view of the aforementioned drawbacks of the conventional power winch, the inventor of the present invention based on the conventional power winch to develop an easily changeable assembly type power winch that can be switched between a horizontal assembly mode or an upright assembly mode to achieve the effects of reducing the manufacturing cost, improving the convenience of assembling, and broadening the scope of application.

The primary objective of the present invention is to provide an easily changeable assembly type power winch that can be switched between a horizontal assembly mode and an upright assembly mode to achieve the effects of reducing the manufacturing cost, improving the convenience of assembling, and broadening the scope of application.

To achieve the above-mentioned objective, the present invention discloses an easily changeable assembly type power winch, comprising a power source, outputting a power from an output end, and driving a rope wheel to perform a forward rotation or a reverse rotation after the transmission of the outputted power is acted by a deceleration device, and the power source and the rope wheel being assembled to be parallel and adjacent to each other, and the common exterior of the output end of the power source and the deceleration device being covered by an outer casing, characterized in that a set of first and second support frames, being rectangular frames, comprises a plurality of engaging holes formed at the periphery of the set of first and second support frames, wherein a joint position of the outer casing of the first support frame support and the rope wheel makes the outer casing and the rope wheel to be disposed on both sides of the first support frame respectively, and the second support frame is mounted onto the other side of the rope wheel, so that the rope wheel is jointly supported by the set of first and second support frames; and a set of cross plates, having a through hole separately formed at four ends of the set of cross plates, and one of the cross plates is disposed on the backside of the set of first and second support frames, and the other cross plate is disposed on the top side of the set of first and second support frames, and each through hole separately formed at four ends of the cross plate is aligned precisely with each respective engaging hole formed at the periphery of the set of first and second support frames, and an engaging member is passed through the through hole and then locked with the engaging hole.

The above-mentioned easily changeable assembly type power winch comprises a rope outlet board, and the rope outlet board having a horizontal rope management slot formed thereon and a through hole formed at four corners of the rope outlet board separately, and the rope outlet board being set on the set of first and second support frames and not locked to the front of the cross plate, such that the through holes at the four corners of the rope outlet board are aligned precisely with the engaging holes of the set of first and second support frames respectively, and then an engaging member is passed through the through hole and locked with the engaging hole.

The above-mentioned easily changeable assembly type power winch comprises an electric control box having a display panel installed at the front thereof, and locked onto the cross plate which is disposed on the top side of the set of first and second support frames, so that the display panel is facing forward.

DETAILED DESCRIPTION OF THE PREFERRED EMBODIMENTS

Figure 1:
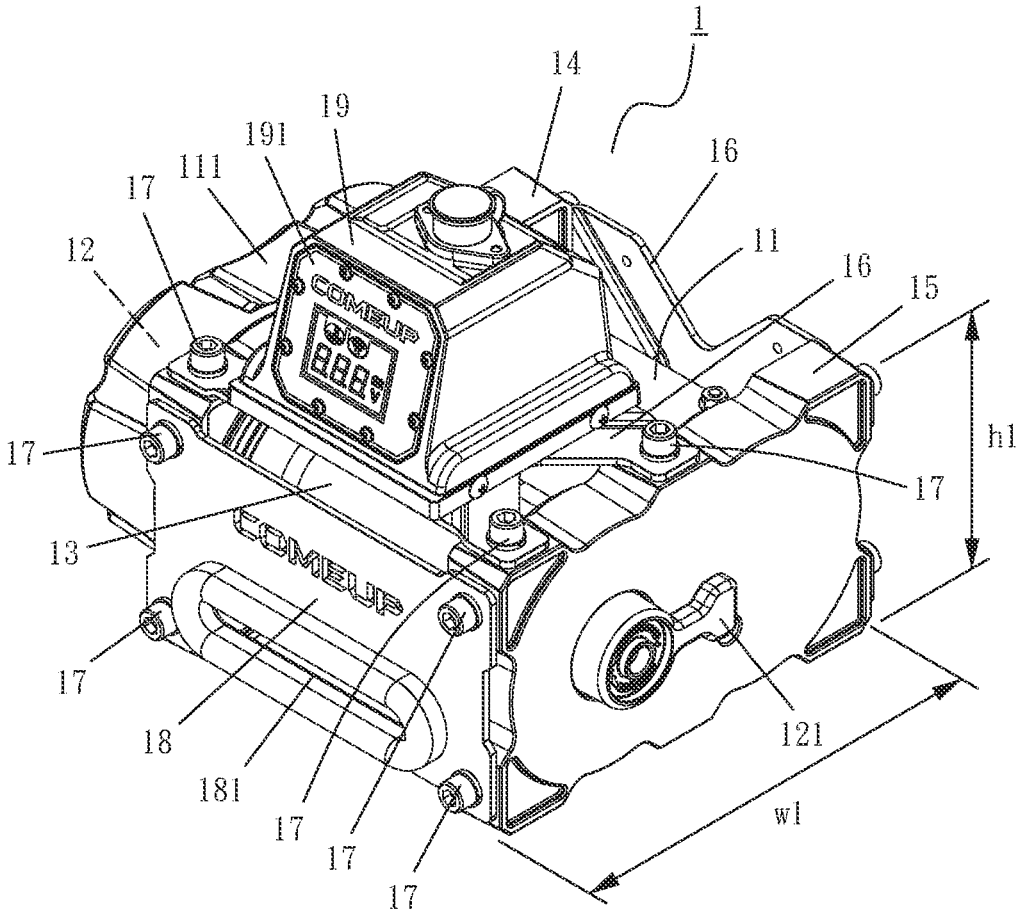
FIG. 1 is a perspective view of the present invention in a horizontal assembly mode.
Figure 2:
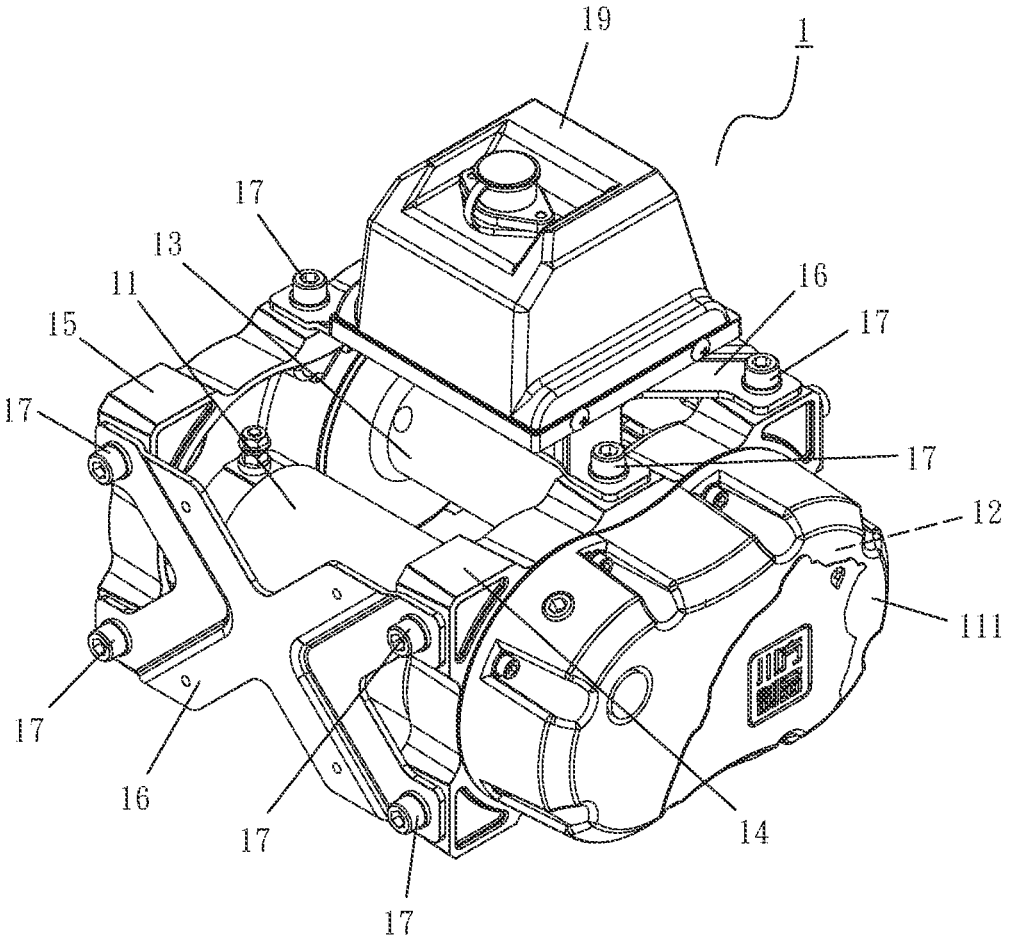
FIG. 2 is another perspective view of the present invention the horizontal assembly mode, viewing from another angle.
Figure 3:
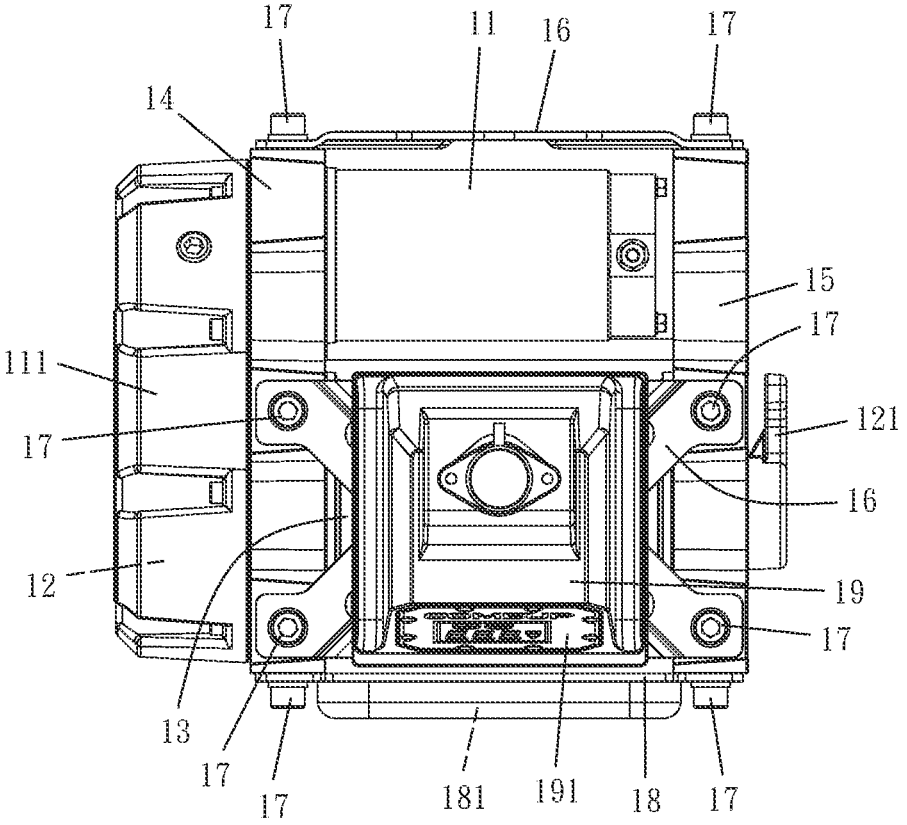
FIG. 3 is a top view of the present invention in the horizontal assembly mode.
Figure 4:
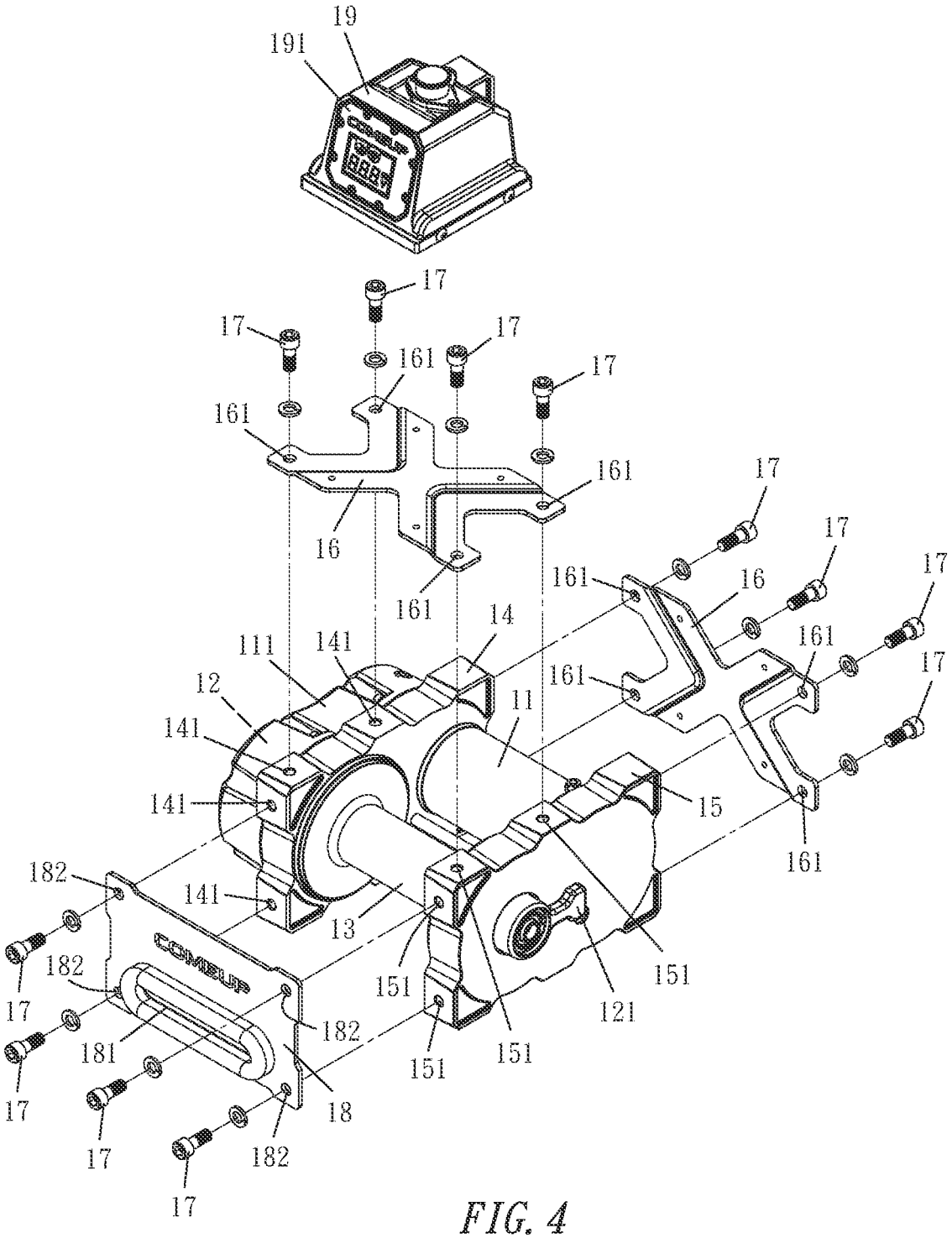
FIG. 4 is an exploded view of the present invention in the horizontal assembly mode.

The present invention will become clearer in light of the following detailed description of an illustrative embodiment of this invention described in connection with the drawings.

With reference to FIGS. 1 to 4 for a power winch 1 in accordance with an embodiment of the present invention, the power winch 1 is assembled in a horizontal assembly mode, and the power winch 1 has a power source 11 (such as a power motor, or an electric motor), and after the power source 11 outputs a power, and the outputted power is transmitted to and acted by a deceleration device 12, a rope wheel 13 is driven to perform a forward rotation or a reverse rotation to release or retract the rope when needed.

In the figures, both of the power source 11 and the rope wheel 13 have a long cylindrical appearance, so that the power source 11 and the rope wheel 13 can be assembled and configured to be parallel and adjacent to each other, and the common exterior of the output end of the power source 11 and the deceleration device 12 is covered by an outer casing 111, so that the output end of the power source 11 and the deceleration device 12 are hidden, and a set of first and second support frames 14, 15 is provided for jointly supporting the aforementioned structure, wherein the joint of the first support frame 14 for supporting the outer casing 111 and the rope wheel 13 is supported by the first support frame 14, so that the outer casing 111 and the rope wheel 13 are disposed on both sides of the first support frame 14 respectively, and the second support frame 15 is mounted onto the other side of the rope wheel 13. In other words, the rope wheel 13 is jointly supported by the set of first and second support frames 14, 15. The deceleration device 12 includes a clutch device for disconnecting the power transmission with the rope wheel 13 (when necessary) in order to release the rope quickly by manpower, and the clutch device includes a clutch handle 121 disposed on an outer sidewall of the second support frame 15.

In order to obtain symmetry of the assembly, the set of first and second support frames 14, 15 are manufactured in form of rectangular frames, and the set of first and second support frames 14, 15 has a plurality of corresponding engaging holes 141, 151 (such as screw holes) formed at symmetrical positions on the periphery of the set of first and second support frames 14, 15, and a set of cross plates 16 (such as two cross plates 16) are provided and a through hole 161 is formed separately at four ends of the set of cross plates 16 for the convenience and stability of the assembling, so that the cross plate 16 can be installed at different positions along the periphery of the set of support frames 14, 15. For example, one of the cross plates 16 is installed at the backside of the set of support frames 14, 15 and the other cross plate 16 is installed at the top side of the set of support frames 14, 15, and each through hole 161 formed separately at four ends of each cross plate 16 is aligned precisely with a respective engaging hole 141 or 151, and then an engaging member 17 (such as a bolt) is passed through the through hole 161 and locked with the engaging hole 141 or 151 securely, so as to couple and support the set of cross plates 16 and achieve a secured structural assembly.

In FIGS. 1 to 4, the power winch 1 is assembled into a horizontal assembly mode, so that its width w1 is greater than its height h1 (as shown in FIG. 1), and a rope outlet board 18 is installed in front of the power winch 1 and along the periphery of the set of support frames 14, 15, and the rope outlet board 18 comprises a horizontal rope management slot 181 formed thereon, and a through hole 182 formed separately at four corners of the rope outlet board 18, so that the rope outlet board 18 is disposed at the front of the set of support frames 14, 15, and each through hole 182 formed separately at four corners of the rope outlet board 18 is aligned precisely with a respective engaging hole 141 and 151, and then an engaging member 17 (such as a bolt) is passed through the through hole 182 and locked securely with the engaging hole 141 and 151, so that the horizontal rope management slot 181 of the rope outlet board 18 can be aligned precisely with the rope wheel 13 and becomes an important inlet/outlet slot of the rope wheel 13 for releasing and retracting the rope. In the meantime, the rope outlet board 18 can help making the assembly between the set of support frames 14, 15 more stable. Finally, an electric control box 19 is installed to (or mounted onto) the cross plate 16 at the top side (which is the second cross plate 16 described above), so that the display panel 191 on the electric control box 19 is facing forward to facilitate its viewing by the operator.

In the structure as disclosed above, the power source 11 and the rope wheel 13 can be installed a spatial range between the set of first and second support frames 14, 15, and then the output end of the power source 11 is passed out from the first support frame 14 and installed onto the deceleration device 12 and the outer casing 111, and then the set of cross plates 16 (such as two cross plates 12) are installed at the backside and the top side of the set of support frames 14, 15 respectively to achieve a secured locking effect, and a basic assembly is formed so far. The next step is to choose a horizontal assembly mode or an upright assembly mode.

With reference to FIGS. 1 to 4 for the horizontal assembly mode, the basic assembly is set to a mode that its width w1 is greater than its height h1 (as shown in FIG. 1), and then the rope outlet board 18 is mounted and locked onto the front cross plate 16 which has not been locked onto the set of support frames 14, 15 yet, and then the engaging member 17 is passed through the corresponding through hole 182 and locked with the corresponding engaging hole 141 and 151, and then the electric control box 19 is mounted onto the top cross plate 16, and the display panel 191 on the electric control box 19 is arranged to be facing forward, so as to complete the assembly in the horizontal assembly mode.

Figure 5:
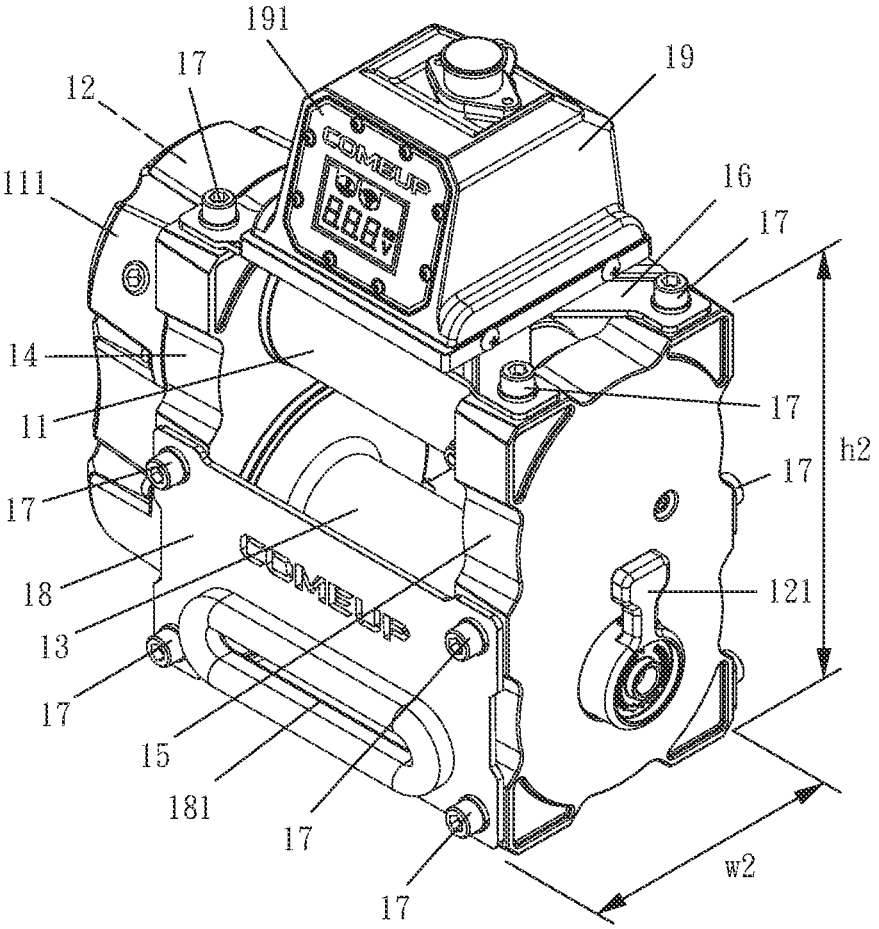
FIG. 5 is a perspective view of the present invention in an upright assembly mode.
Figure 6:
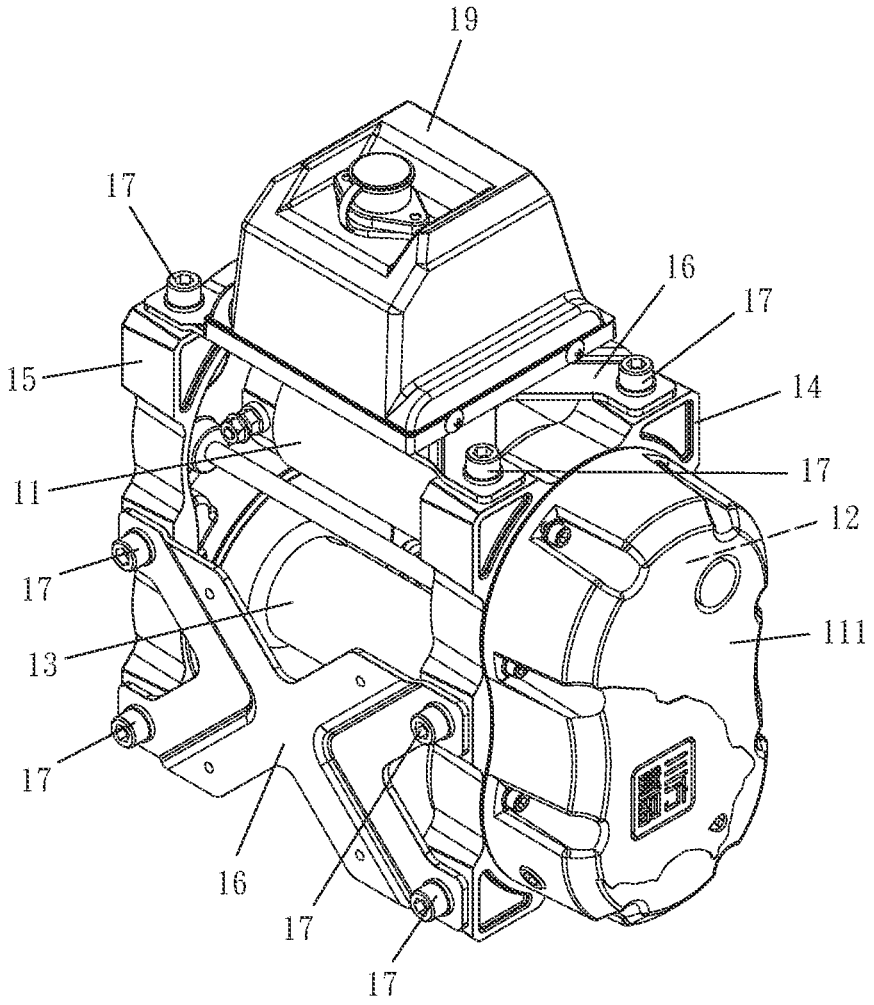
FIG. 6 is another perspective view of the present invention in the upright assembly mode.
Figure 7:
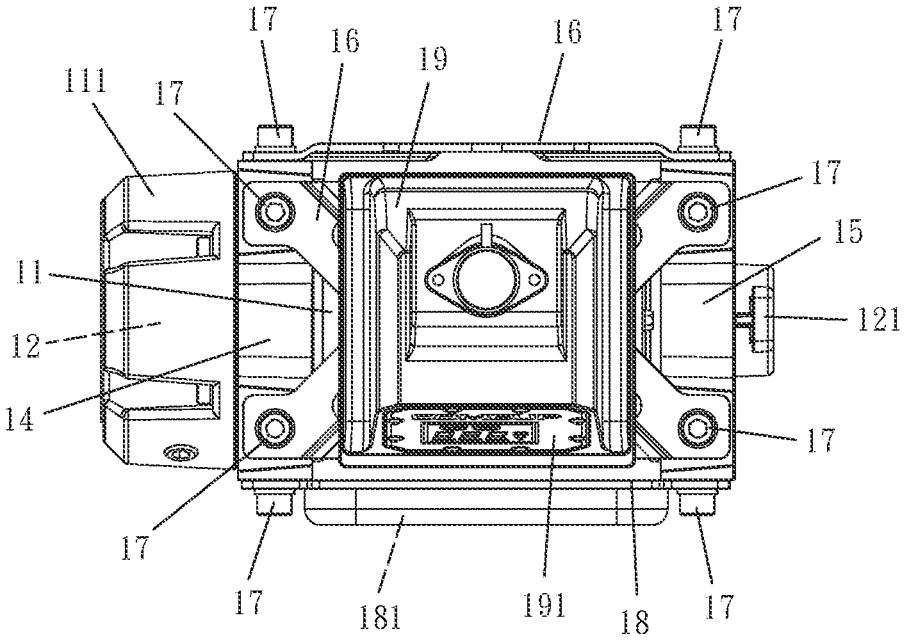
FIG. 7 is a top view of the present invention in the upright assembly mode.
Figure 8:
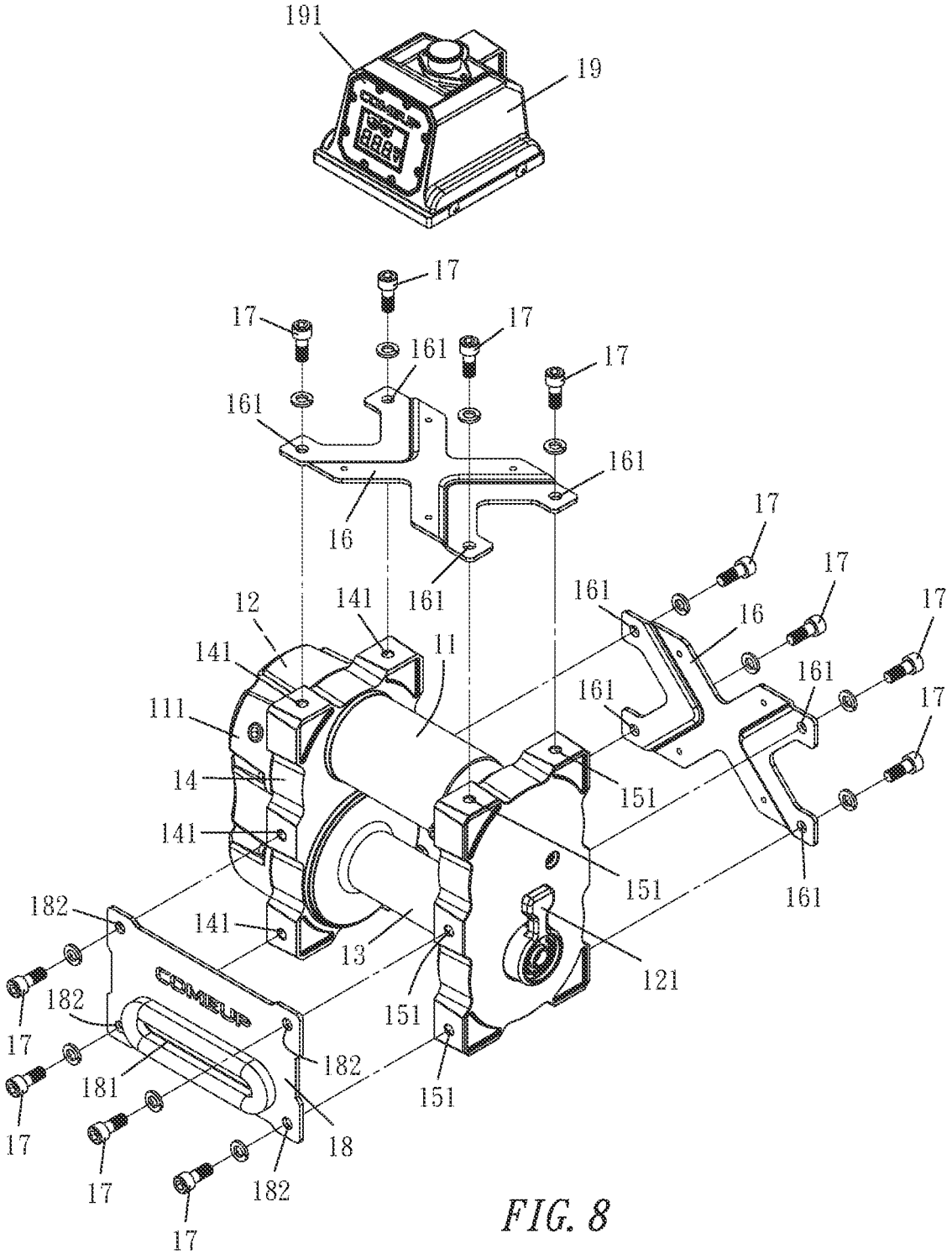
FIG. 8 is an exploded view of the present invention in the upright assembly mode.

With reference to FIGS. 5 to 8 for the upright assembly mode, the basic assembly is rotated and set to a mode that its width w2 is smaller than its height h2 (as shown in FIG. 5), and then the rope outlet board 18 is mounted onto the front cross plate 16 which has not been locked onto the set of support frames 14, 15 yet, and then the engaging member 17 is passed through the corresponding through hole 182 and locked with the corresponding engaging hole 141 and 151, so that the horizontal rope management slot 181 of the rope outlet board 18 is aligned precisely with the rope wheel 13 and becomes an important inlet/outlet of the rope wheel 13 for releasing and retracting the rope, and then the electric control box 19 is mounted and locked onto the top cross plate 16, and the display panel 191 on the electric control box 19 is facing forward, so as to complete the assembly in the upright assembly mode.

From the description above, as long as the power winch 1 has the power source 11, the deceleration device 12, the outer casing 111, the rope wheel 13, the first and second support frames 14, 15 and the set of cross plates 16 (or two cross plates 16) are assembled to produce a basic assembly, the rope outlet board 18 and the electric control box 19 can be assembled with the basic assembly to produce an assembly in the horizontal assembly mode or the upright assembly mode, and the two assembly modes can be switched quickly, so that the power winch 1 has the effects of reducing the manufacturing cost, improving the convenience of assembling, and improving the scope of application.

In summation of the description above, the easily changeable assembly type power winch of the present invention is novel, and the invention can achieve the expected effects and comply with the patent application requirements, and thus is duly filed for patent application.

What is claimed is:

1. An easily changeable assembly type power winch, comprising a power source, outputting a power from an output end, and driving a rope wheel to perform a forward rotation or a reverse rotation after the transmission of the outputted power is acted by a deceleration device, and the power source and the rope wheel being assembled to be parallel and adjacent to each other, and the common exterior of the output end of the power source and the deceleration device being covered by an outer casing, characterized in that a set of first and second support frames, being rectangular frames, comprises a plurality of engaging holes formed at the periphery of the set of first and second support frames, wherein a joint position of the outer casing of the first support frame support and the rope wheel makes the outer casing disposed on one side of the first support frame and the rope wheel disposed on another side of the first support frame, and the second support frame is mounted onto the other side of the rope wheel, so that the rope wheel is jointly supported by the set of first and second support frames; and a set of cross plates, having a through hole separately formed at four ends of the set of cross plates, and one of the cross plates is disposed on the backside of the set of first and second support frames, and the other cross plate is disposed on the top side of the set of first and second support frames, and each through hole separately formed at four ends of the set of cross plates is aligned precisely with each respective engaging hole formed at the periphery of the set of first and second support frames, and a first engaging members are passed through each of the through holes of the cross plates and then locked with the engaging holes of the first and second support frames, and a rope outlet board, and the rope outlet board having a horizontal rope management slot formed thereon and a second through hole formed at four corners of the rope outlet board separately, and the rope outlet board being set on the set of first and second support frames and not locked to the front of the cross plate, such that the second through holes at the four corners of the rope outlet board are aligned precisely with second engaging holes of the set of first and second support frames respectively, and then second engaging members are passed through the second through holes, and locked with the second engaging holes.

2. The easily changeable assembly type power winch as claimed in claim 1, further comprising an electric control box having a display panel installed at the front thereof, and locked onto the cross plate which is disposed on the top side of the set of first and second support frames, so that the display panel is facing forward.

* * * * *